US008979589B2

(12) United States Patent
Kanda et al.

(10) Patent No.: US 8,979,589 B2
(45) Date of Patent: Mar. 17, 2015

(54) SHIELD CONNECTOR

(71) Applicant: Yazaki Corporation, Minato-ku, Tokyo (JP)

(72) Inventors: Hidenori Kanda, Makinohara (JP); Koji Miyawaki, Susono (JP)

(73) Assignee: Yazaki Corporation, Tokyo (JP)

( * ) Notice: Subject to any disclaimer, the term of this patent is extended or adjusted under 35 U.S.C. 154(b) by 57 days.

(21) Appl. No.: 13/728,516

(22) Filed: Dec. 27, 2012

(65) Prior Publication Data

US 2013/0171872 A1 Jul. 4, 2013

(30) Foreign Application Priority Data

Dec. 28, 2011 (JP) ..... 2011-289310

(51) Int. Cl.

| | |
|---|---|
| ***H01R 9/03*** | (2006.01) |
| ***H01R 13/6593*** | (2011.01) |
| ***H01R 13/213*** | (2006.01) |
| ***H01R 24/44*** | (2011.01) |
| *H01R 9/05* | (2006.01) |

(52) U.S. Cl.

CPC ..... *H01R 13/6593* (2013.01); *H01R 9/0518* (2013.01); *H01R 13/213* (2013.01); *H01R 24/44* (2013.01)

USPC ..... 439/607.41

(58) Field of Classification Search

USPC ..... 439/607.41, 585, 578, 750, 394, 375

See application file for complete search history.

(56) References Cited

U.S. PATENT DOCUMENTS

| | | | | |
|---|---|---|---|---|
| 3,660,805 | A * | 5/1972 | McDonough | 439/585 |
| 3,743,748 | A * | 7/1973 | Reeder | 174/75 C |
| 4,031,614 | A * | 6/1977 | Gipe | 29/879 |
| 6,083,034 | A * | 7/2000 | Kameyama | 439/394 |
| 6,200,162 | B1 * | 3/2001 | Aoyama et al. | 439/578 |
| 6,210,223 | B1 | 4/2001 | Aoyama et al. | |
| 6,217,379 | B1 * | 4/2001 | D'Hulster et al. | 439/752.5 |
| 7,217,156 | B2 | 5/2007 | Wang | |
| 7,867,002 | B1 * | 1/2011 | Lin et al. | 439/292 |
| 2005/0287875 | A1 * | 12/2005 | Kojima | 439/750 |
| 2006/0160419 | A1 * | 7/2006 | Wang | 439/579 |

FOREIGN PATENT DOCUMENTS

| | | |
|---|---|---|
| JP | 2011-034773 A | 2/2011 |
| JP | 2011-065882 A | 3/2011 |

OTHER PUBLICATIONS

Notification of First Office Action mailed Sep. 23, 2014 corresponding to Chinese Patent Application No. 201210587162.0.

* cited by examiner

*Primary Examiner* — Jean F Duverne
(74) *Attorney, Agent, or Firm* — Sughrue Mion, PLLC

(57) ABSTRACT

An inner terminal connected to a terminal of a core wire and provided with an electric connecting portion electrically connected with a mating terminal is received in an inner housing. The inner housing is incorporated into an outer terminal. The outer terminal is mated with a mating connector in such a state as that the shield member is connected to the outer terminal and the electric connecting portion of the inner terminal is positioned in the outer terminal. The outer terminal has the same configuration as that of an outer terminal of the mating connector, thus making the outer terminals sharable between male and female connectors.

4 Claims, 10 Drawing Sheets

SHIELD CONNECTOR

BACKGROUND OF THE INVENTION

1. Field of the Invention

The present invention relates to a shield connector used for allowing shield electric cables to be connected with each other by mating a male connector and a female shield with each other.

2. Description of the Related Art

FIG. 1 shows a conventional shield connector described in Japanese Patent Unexamined Publication No. 2011-34773 (Patent Literature 1) and Japanese Patent Unexamined Publication No. 2011-65882 (Patent Literature 2). A shield connector is formed with a male shield connector 110 and a female shield connector 120. The male and female shield connectors 110, 120 are used for connecting shield electric cables 130.

The shield electric cable 130 has a coaxial structure formed with a core wire 131 made by twining together a plurality of wires, an inner cover 132 made of an insulation covering the core wire 131, a shield member 133 made of a braided wire covering an outer periphery of the inner cover 132 and an outer cover 134 made of an insulation covering an outer periphery of the shield member 133. The core wire 131 serves to transmit a high frequency signal and the male and female connectors 110, 120 are used for connecting the core wires 131.

The male and female connectors 110, 120 are formed respectively with inner terminals 111, 121 connected to the core wires 131 of the shield electric cables 130, outer terminals 112, 122 connected to the shield members 133 of the shield electric cables 130 and inner housings 113, 123 receiving therein the inner terminals 111, 121.

The inner terminals 111, 121 are made of conductive metal where electric connecting portions 111*a*, 121*a* on the distal end sides are integrated respectively with crimp barrel portions 111*b*, 121*b* on the base end sides. The crimp barrel portions 111*b*, 121*b* are crimped to the core wires 131 (of the shield electric cables 130) exposed by peeling off the inner covers 132, thus fixing the core wires 131 to be conductive with the core wires 131. Mating the male shield connector 110 with the female shield connector 120 allows the electric connecting portions 111*a*, 121*a* to contact each other and to be conductive with each other. In this case, an electric connecting portion 111*a* of the male shield connector 110 is formed into a thin cylinder and an electric connecting portion 121*a* of the female shield connector 120 is formed into a thick cylinder. The electric connecting portion 111*a* of the mating connector 110 on the male side enters into the electric connecting portion 121*a* of the shield connector 120 on the female side, to thereby allow the electric connecting portions 111*a*, 121*a* to be electrically connected with each other.

The inner housings 113, 123 made of insulation resin receive the respective inner terminals 111, 121. In the state of receiving the inner terminals 111, 121, the inner housings 113, 123 are assembled into the respective outer terminals 112, 122.

The outer terminals 112, 122 are formed with conductive metal where cylindrical portions 112*a*, 122*a* on the distal end sides are integrated respectively with the shield member connecting portions 112*b*, 122*b* on the base end sides. The shield member connecting portions 112*b*, 122*b* on the base end sides are crimped to the shield members 133 exposed by peeling off the outer covers 134. This crimping connects the shield member connecting portions 112*b*, 122*b* to the shield members 133 of the shield electric cables 130.

The cylindrical portions 112*a*, 122*a* are members for mating the mating connector 110 with the shield connector 120 and formed into configurations capable of mating with each other. In FIG. 1, the cylindrical portion 112*a* of the male shield connector 110 is formed into a cylinder having a large diameter and the cylindrical portion 122*a* of the female shield connector 120 is formed into a cylinder having a small diameter, thus rendering the mutual mating. This mating brings the shield electric cables 130 connected to the shield connectors 110, 120 into a connection state. In this way, the outer terminals 112, 122 are formed into different configurations for allowing the mutual mating.

SUMMARY OF THE INVENTION

In the conventional structure, for connecting the male shield connector 110 with the female shield connector 120, it is necessary to mate outer terminals 112, 122 have different configurations. This caused such a problems as that not only special metal molds for preparing the outer terminals 112, 122 are individually needed, but also the metal mold cost is increased. Further, for crimping the shield members 133 of the shield electric cables 130 to the shield member connecting portions 112*b*, 122*b* of the outer terminals 112, 122, different applicators should be used, thus making the crimping operation cumbersome.

It is therefore an object of the present invention to provide male and female shield connectors capable of being mated with each other without the need of having the outer terminals formed into different configurations thus enabling to share a metal mold and an applicator between the male and female connectors and to reduce cost.

A first aspect of the present invention provides a shield connector to be connected to a terminal of a shield electric cable having a core wire with an outer periphery covered with a shield member via insulation, the shield connector comprising: an inner terminal connected to an end of the core wire and provided with an electric connecting portion electrically connected with a mating terminal; an insulation inner housing to receive therein the inner terminal; and an outer terminal into which the inner housing receiving therein the inner terminal is incorporated, and which is to be mated with a mating connector in a state where the shield member is connected to the outer terminal and the electric connecting portion of the inner terminal is positioned in the outer terminal, wherein the outer terminal has the same configuration as that of an outer terminal of the mating connector, thus making the outer terminals sharable between male and female connectors.

The outer terminal may include: a terminal body portion incorporating the inner housing which receives the inner housing receiving the inner, a shield member connecting portion to which the shield member is connected, and a cylindrical portion in which the electric connecting portion of the inner terminal is positioned and which is to be mated with the mating connector, wherein the cylindrical portion may include a first semi-cylindrical wall formed with a slit and a second semi-cylindrical wall opposing the first semi-cylindrical wall, the outer terminal of the shield connector and the outer terminal of the mating connector may be mated with each other in a reversed state (upside down) in the mating state of the shield connector with the mating connector, the first semi-cylindrical wall of the outer terminal of the shield connector may be positioned inside a second semi-cylindrical wall of the outer terminal of the mating connector, and a first cylindrical wall of the outer terminal of the mating connector may be positioned inside the second semi-cylindrical wall of the outer terminal of the shield connector.

The cylindrical portion of the shield connector may be provided with a stopper portion, the mating connector may include a cylindrical portion provided with a stopper portion, and the stopper portion of the shield connector and the stopper portion of the mating connector may be engaged with each other, to thereby prevent an upward-downward deviation of the shield connector and the mating connector.

According to the first aspect of the present invention, the outer terminal has the same configuration as that of the outer terminal of the mating connector, thus making the outer terminals sharable between the male and female shield connectors. Thus, the mating can be accomplished without preparing the outer terminals in different configurations between the male and female shield connectors. Thus, the metal mold for producing the outer terminals and the applicator for crimping the outer terminals to the shield electric cable can be shared, thus enabling to reduce the cost, and besides improving the workability.

Further, since the cylindrical portion of the outer terminal is mated with the outer terminal of the mating connector in an upside-down state, the outer terminals of the male and female connectors can be easily mated. Further, the outer terminals are mated in such a configuration as that the first semi-cylindrical wall of the cylindrical portion is positioned inside the second semi-cylindrical wall of the outer terminal of the mating connector, and the first semi-cylindrical wall of the outer terminal of the mating connector is positioned inside the second semi-cylindrical wall, thus the cylindrical portion of the shield connector and the cylindrical portion of the mating connector can be mated in a mutually positioned manner. Thus, the outer terminal of the shield connector and the outer terminal of the mating connector can be reliably mated, thus stabilizing the mating state.

Further, the stopper portions engaged with each other to prevent the upward-downward deviation are provided at the cylindrical portion of the outer terminal of the shield connector and the cylindrical portion of the outer terminal of the mating connector, thus enabling to maintain the accuracy of the mating state with the mating connector.

DESCRIPTION OF THE EMBODIMENTS

An embodiment of the present invention will be explained with reference to FIG. 2 to FIG. 11.

Figure 11:
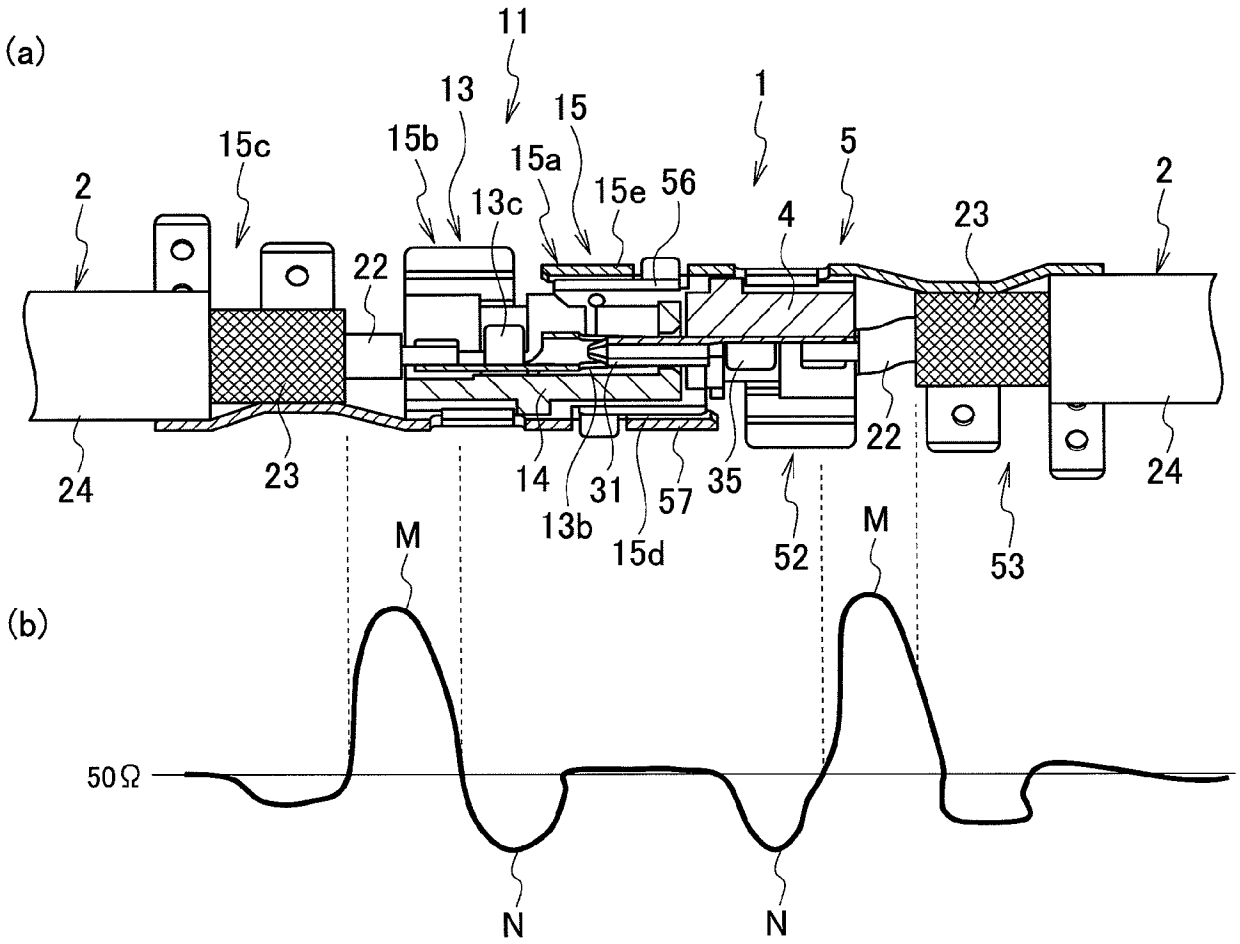
FIG. 11(*a*) is a cross sectional view showing a state in which the shield connector is connected with the mating connector and FIG. 11(*b*) is a graph showing an impedance characteristic responding to FIG. 11(*a*), according to the embodiment of the present invention.

As shown in FIG. 11, a shield connector 1 is mated and electrically connected with a mating connector 11, to thereby allow shield electric cables 2 (connected respectively with the connectors 1, 11) to be connected with each other. The mating of the connectors 1, 11 is implemented with outer terminals 5, 15 of the shield connector 1 and mating connector 11 having the same configuration and with the outer terminals 5, 15 of the connectors 1, 11 reversed upside down (refer to FIG. 5, FIG. 6 and FIG. 11). As the mating connector 11, one like the shield connector 1 is used.

Figure 1:
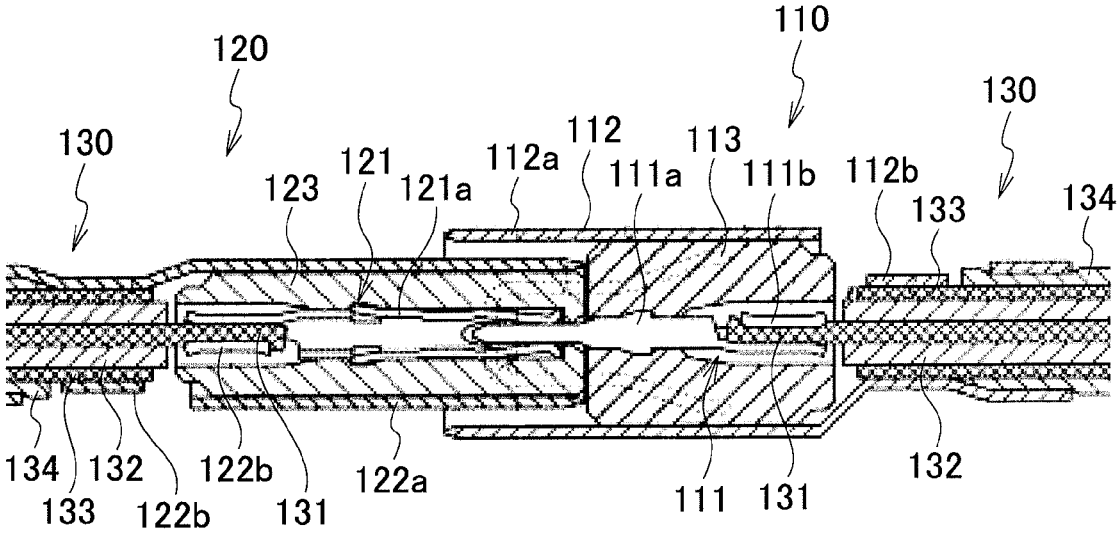
FIG. 1 is a cross sectional view showing a male shield connector and a female shield connector mated with each other, according to a conventional example.
Figure 2:
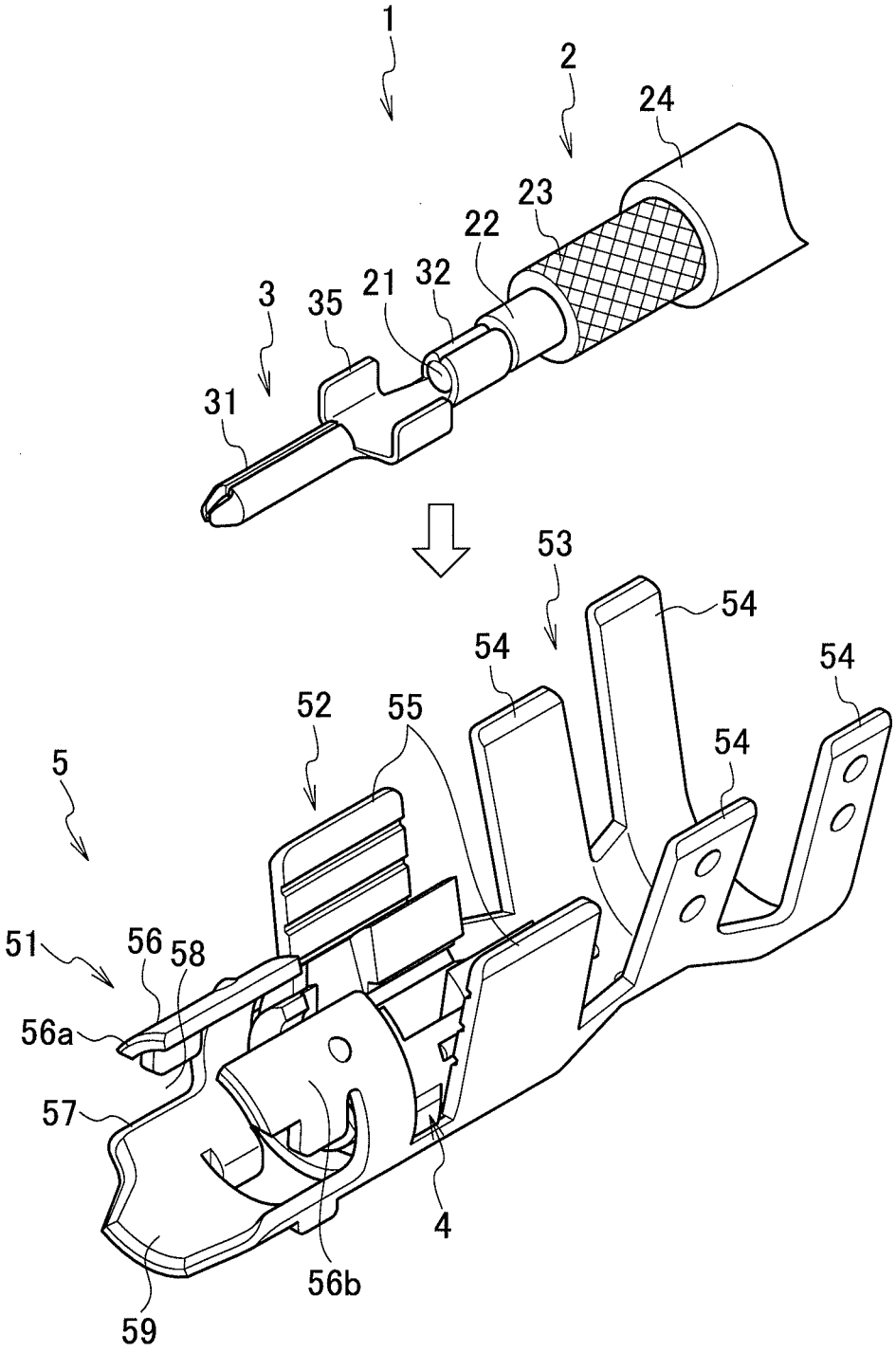
FIG. 2 is a perspective view showing that a shield connector has been assembled, according to an embodiment of the present invention.

As shown in FIG. 2, a shield electric cable 2 is connected to the shield connector 1. As shown in FIG. 2 and FIG. 11, the shield electric cable 2 has a coaxial structure formed by a central core wire 21 formed by twining together a plurality of conductive wires, an inner cover 22 made of an insulation resin and so provided as to cover an outer periphery of the core wire 21, a shield member 23 made of conductive braided wires and so provided as to cover an outer periphery of the inner cover 22 and an outer cover 24 made of an insulation resin and so provided as to cover an outer periphery of the shield member 23. The core wire 21 transmits a high frequency signal and the shield member 23 shields an electromagnetic wave. The above shield electric cable 2 is used for connection with the shield connector 1 with the shield member 23 exposed by peeling off the outer cover 24 and the core wire 21 exposed by peeling off the inner cover 22.

As shown in FIG. 2 and FIG. 11, the shield connector 1 is formed with an inner terminal 3, an inner housing 4 and an outer terminal 5. The mating connector 11 to be connected with the shield connector 1 is also formed with an inner terminal 13, an inner housing 14 and an outer terminal 15. As will be described later, the outer terminal 15 of the mating connector 11 is formed into the same configuration as that of the outer terminal 5 of the shield connector 1.

The entirety of each of the inner terminal 3 and outer terminal 5 of the shield connector 1 is made of a conductive metal and the inner housing 4 is made of an insulation resin. The core wire 21 of the shield electric cable 2 is connected to the inner terminal 3 and the shield member 23 of the shield electric cable 2 is connected to the outer terminal 5.

Figure 3:
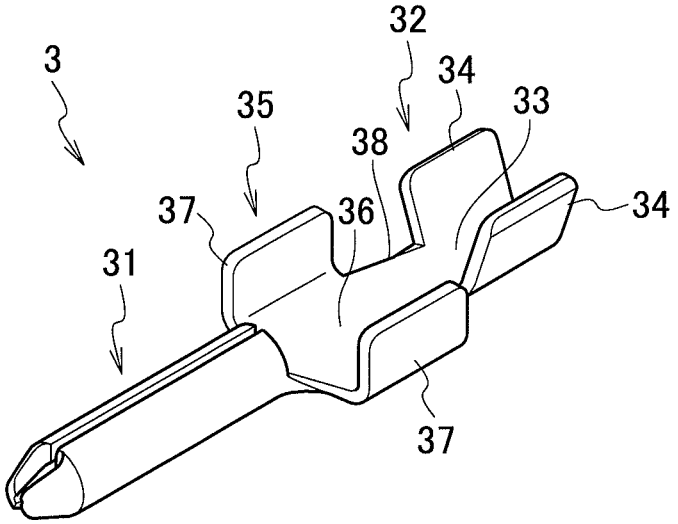
FIG. 3 is a perspective view of an inner terminal of the shield connector, according to the embodiment of the present invention.

FIG. 3 shows the inner terminal 3, where an electric connecting portion 31 connected with the inner terminal 13 of the mating connector 11 is provided at a distal end side in an axial direction and a crimp barrel portion 32 connected with the core wire 21 of the shield electric cable 2 is provided at a base end side in the axial direction. The electric connecting portion 31 in a form of a tapered cylinder extends in the axial direction. By entering into and having a contact with the inner terminal 13 of the mating connector 11, the electric connecting portion 31 becomes conductive with the inner terminal 13 of the mating connector 11 (refer to FIG. 11). Thus, the shield connector 1 according to the embodiment is a male connector and the mating connector 11 is a female connector.

The crimp barrel portion 32 includes a bottom piece 33 and a pair of rectangular plate-like crimp pieces 34 rising from respective sides of the bottom piece 33. The crimp barrel portion 32 is formed into substantially an alphabetical U having an open upper portion. The core wire 21 (of the shield electric cable 2) exposed by peeling off the inner cover 22, with its terminal contacting the electric connecting portion 31, is inserted into the electric connecting portion 31. Further, a terminal portion following the terminal contacts the bottom piece 33 of the crimp barrel portion 32. Then, with the terminal portion contacting the bottom piece 33, the crimp pieces 34 are bent and crimped to the core wire 21, to thereby fix the core wire 21 to the inner terminal 3. The above summarizes that the core wire 21 of the shield electric cable 2 is fixed to the inner terminal 3 in an electrical connecting state with the inner terminal 3.

The inner terminal 3 is provided with an impedance adjusting portion 35. The impedance adjusting portion 35 is to be provided between the electric connecting portion 31 and the crimp barrel portion 32. Between the electric connecting portion 31 and the bottom piece 33 of the crimp barrel portion 32, the impedance adjusting portion 35 has a bottom plate portion 36 continuous with the electric connecting portion 31 and bottom piece 33. Further, the impedance adjusting portion 35 is formed into substantially U-shape having a pair of rectangular plate-like side plate portions 37 rising from respective sides of the bottom plate portion 36 in such a manner as to extend in a substantially vertical direction. In this case, the pair of side plate portions 37 are formed to be positioned in such a manner as to protrude more outwardly than the pair of crimp pieces 34 of the crimp barrel portion 32. That is, the bottom plate portion 36 is larger in width than the bottom piece 33 of the crimp barrel portion 32, and the pair of side plate portions 37 are provided on respective sides of the bottom plate portion 36 having the large width, thereby the rectangular plate-like side plate portions 37 are positioned more outside than the crimp pieces 34 of the crimp barrel portion 32. With the side plate portions 37 positioned outwardly as described above, the impedance adjusting portion 35 is mated with the inner housing 4 (a later discussed mating groove portion 42 of the inner housing 4), thus allowing the impedance adjusting portion 35 to position the inner terminal 3 relative to the inner housing 4. Further, the side plate portion 37 of the impedance adjusting portion 35 is provided in a position adjacent, via a cutout portion 38, to the crimp piece 34 of the crimp barrel portion 32 on the base end side.

With respect to the impedance adjusting portion 35, the core wire 21 (of the shield electric cable 2) extending from the electric connecting portion 31 to the crimp barrel portion 32 contacts the bottom plate portion 36, thus allowing the side plate portions 37 to surround the core wire 21 from right and left in this contact state. Thus, in a portion of forming the impedance adjusting portion 35, the impedance is lowered, and even if there is a portion having a high impedance at other portion of the shield connector 1, the impedance of the entirety of the shield connector 1 is adjusted to be averaged. Thus, the high frequency performance can be improved. Providing the impedance adjusting portion 35 at the inner terminal 3 dispenses with adding to the shield connector 1 other additional parts for averaging the impedance, thus preventing increase of the number of parts of the shield connector 1 as well as facilitating assembling of the shield connector 1.

The above inner terminal 3 is received in the inner housing 4 and the inner housing 4 receiving therein the inner terminal 3 is assembled into the outer terminal 5.

Figure 4:
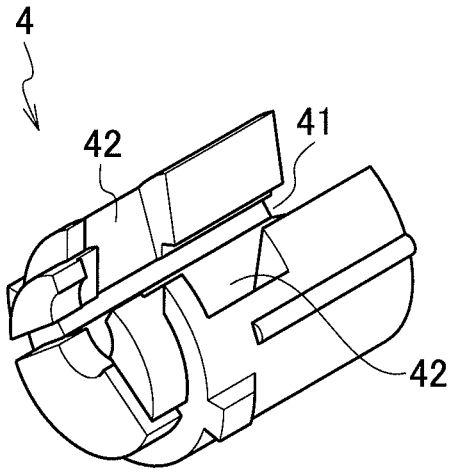
FIG. 4 is a perspective view showing an inner housing of the shield connector, according to the embodiment of the present invention.

As shown in FIG. 4, the inner housing 4 is formed to be substantially cylindrical extending in the axial direction. The inner housing 4 is formed with a receiving recess portion 41 along the axial direction. The receiving recess portion 41 has an upper portion opened, and the inner terminal 3 is dropped into the receiving recess portion 41 from the opened upper portion of the receiving recess portion 41. This dropping-in allows the inner terminal 3 to be received in the inner housing 4. With the inner terminal 3 received in the inner housing 4, the electric connecting portion 31 of the inner terminal 3 protrudes from a distal end of the inner housing 4 toward a mating terminal 13, thus allowing the electric connecting portion 31 to have contact with the mating terminal 13 (refer to FIG. 7 and FIG. 11).

The receiving recess portion 41 is formed with the mating groove portions 42. The mating groove portion 42 is rectangular and formed on each of both sides in the center portion in the longitudinal direction of the receiving recess portion 41. The side plate portion 37 of the impedance adjusting portion 35 of the inner terminal 3 mates with the mating groove portion 42. With the side plate portion 37 mated with the mating groove portion 42, the inner terminal 3 is fixed to the inner housing 4 in a state in which positioning of the inner terminal 3 relative to the inner housing 4 has been made. Thus, the inner terminal 3 can be surely received in a fixed position of the inner housing 4.

As shown in FIG. 2, the outer terminal 5 has such a structure as that a cylindrical portion 51, a terminal body portion 52 and a shield member connecting portion 53 are continuously formed from the distal end side to the base end side in the axial direction.

The shield member connecting portion 53 on the base end side is formed to have two combinations of a pair of rectangular plate-like crimp pieces 54 rising in an opposed manner along the longitudinal direction. The shield member connecting portion 53 is to be fix the shield member 23 (of the shield electric wire 2) which was exposed by peeling off the outer cover 24. This fixing is accomplished after the inner housing 4 receiving therein the inner terminal 3 is set at the terminal body portion 52 by crimping the crimp piece 54, the peeled-off shield member 23 getting out on the base end side of the inner housing 4. This operation brings the shield member 23 of the shield electric cable 2 into a conductive state with the outer terminal 5.

The terminal body portion 52 is positioned closer to the distal end side in the axial direction than the shield member connecting portion 53 and has a pair of rectangular plate-like body pieces 55 rising in an opposed manner. The inner housing 4 receiving therein the inner terminal 3 is incorporated into the terminal body portion 52 so as to be positioned between the body pieces 55. While the inner housing 4 being incorporated into the terminal body portion 52, the body pieces 55, covering the outside of the inner housing 4 on respective sides of the inner housing 4, serves to reduce the exposing amount of the inner housing 4.

Figure 6:
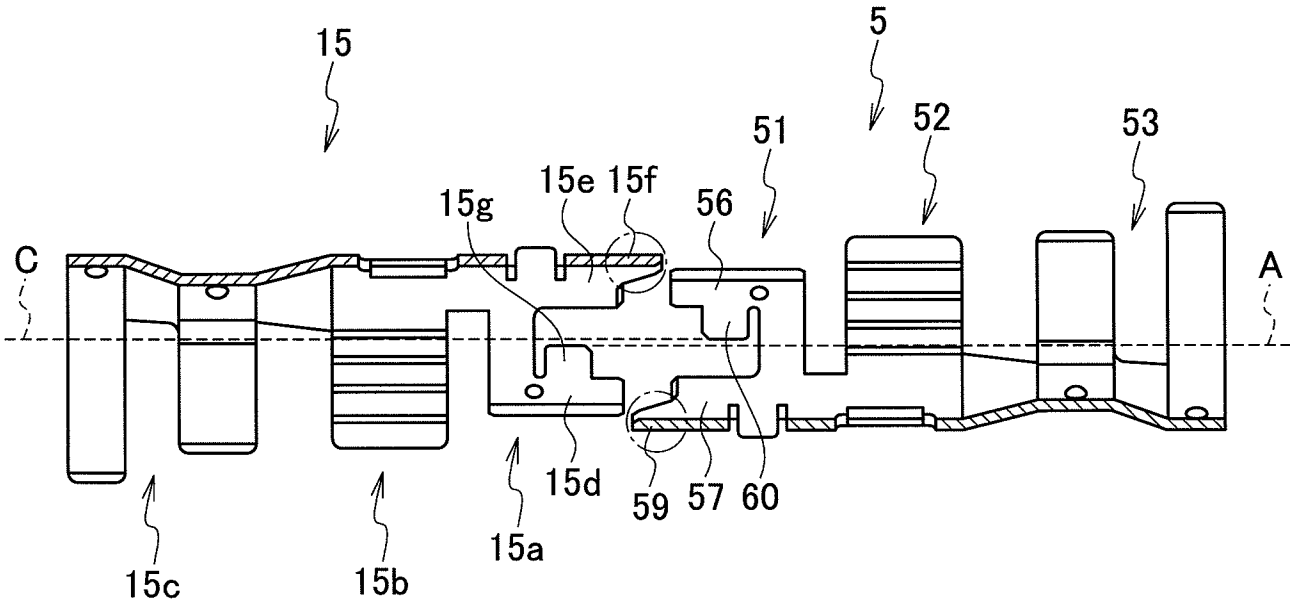
FIG. 6 is a cross sectional view showing an inside of the connected state in FIG. 5.
Figure 7:
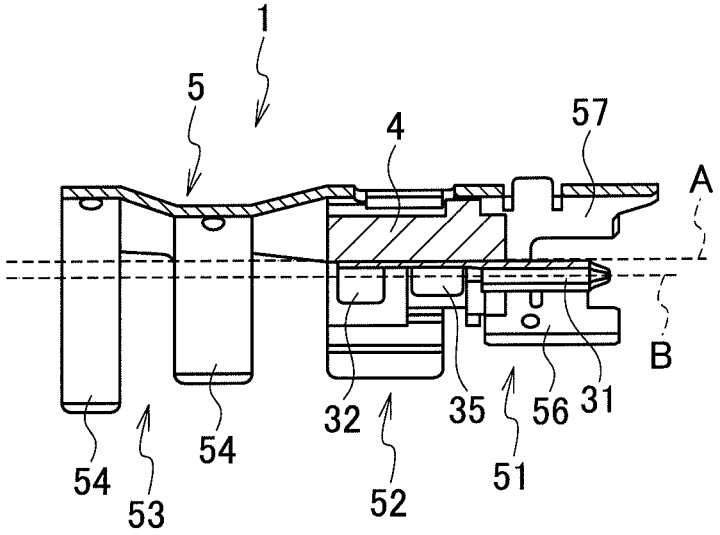
FIG. 7 is a cross sectional view for explaining the connection with the mating connector.
Figure 8:
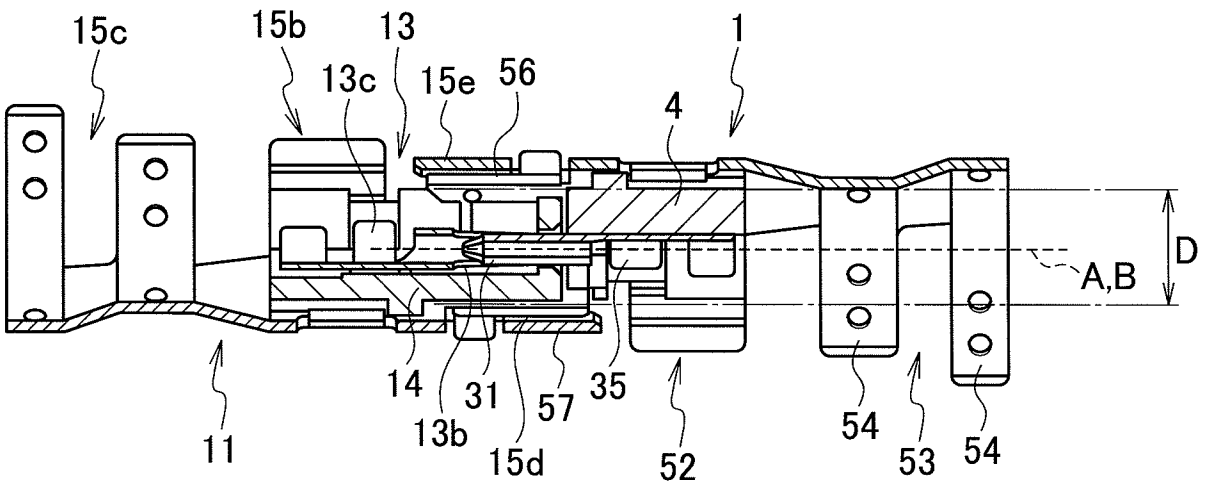
FIG. 8 is a cross sectional view for explaining the connection with the mating connector.
Figure 9:
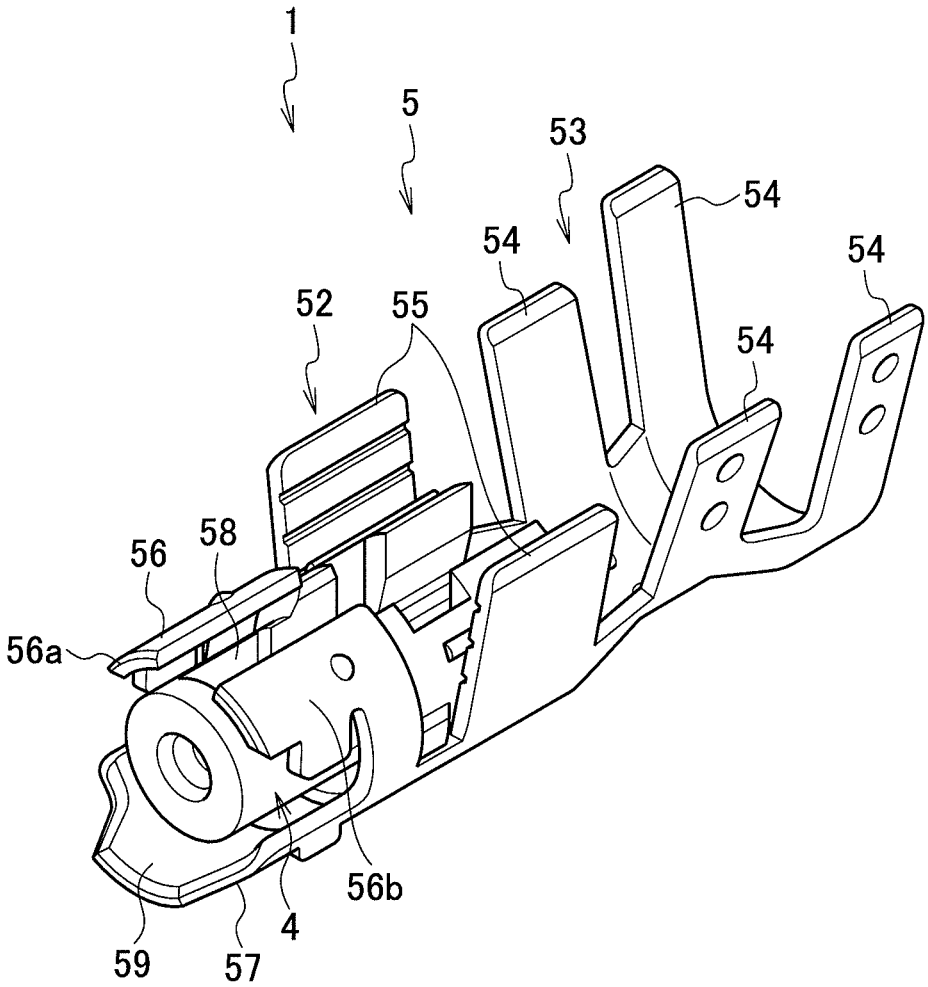
FIG. 9 is a perspective view showing a state in which the inner housing of the shield connector is assembled into the outer terminal, according to the embodiment of the present invention.

The cylindrical portion 51 thus provided closer to the distal end side in the axial direction than the terminal body portion 52 is positioned on the mating connector side. The entirety of the cylindrical portion 51 has a cylindrical outer configuration, into which, as shown in FIG. 9, the substantially cylindrical inner housing 4 is inserted. Further, as shown in FIG. 7 and FIG. 11, the electric connecting portion 31 (of the inner terminal 3) getting out from the distal end of the inner housing 4 is positioned inside the cylindrical portion 51. As shown in FIG. 6, FIG. 8 and FIG. 11, the cylindrical portion 51 is to be mated with the mating connector 11, thus accomplishing connecting of the male and female connectors.

The cylindrical portion 51 is formed with a first semi-cylindrical wall 56 and a second semi-cylindrical wall 57, respectively, positioned in upper and lower positions. The first semi-cylindrical wall 56 is formed with a slit 58 along the longitudinal direction (refer to FIG. 2 and FIG. 9). Forming of the slit 58 brings the first semi-cylindrical wall 56 into a state of having two divided pieces 56*a*, 56*b*. In the above structure, elasticity capable of sagging and recovering is given to each of the divided pieces 56*a*, 56*b*. With the elasticity given to the divided pieces 56*a*, 56*b*, the first semi-cylindrical wall 56 sags at the time of mating with the mating connector 11, thus enabling to easily mate the cylindrical portion 51 with the mating connector 11.

The second semi-cylindrical wall 57 in the lower position is so formed as to oppose the first semi-cylindrical wall 56 in the upper position. The second semi-cylindrical wall 57 has a connector pick protrusion at its distal end. The connector pick protrusion 59 operates to pick the mating connector 11 at the time of mating with the mating connector 11. Thus, the mating of the male and female connectors 1, 11 can be accomplished easily and reliably.

Figure 10:
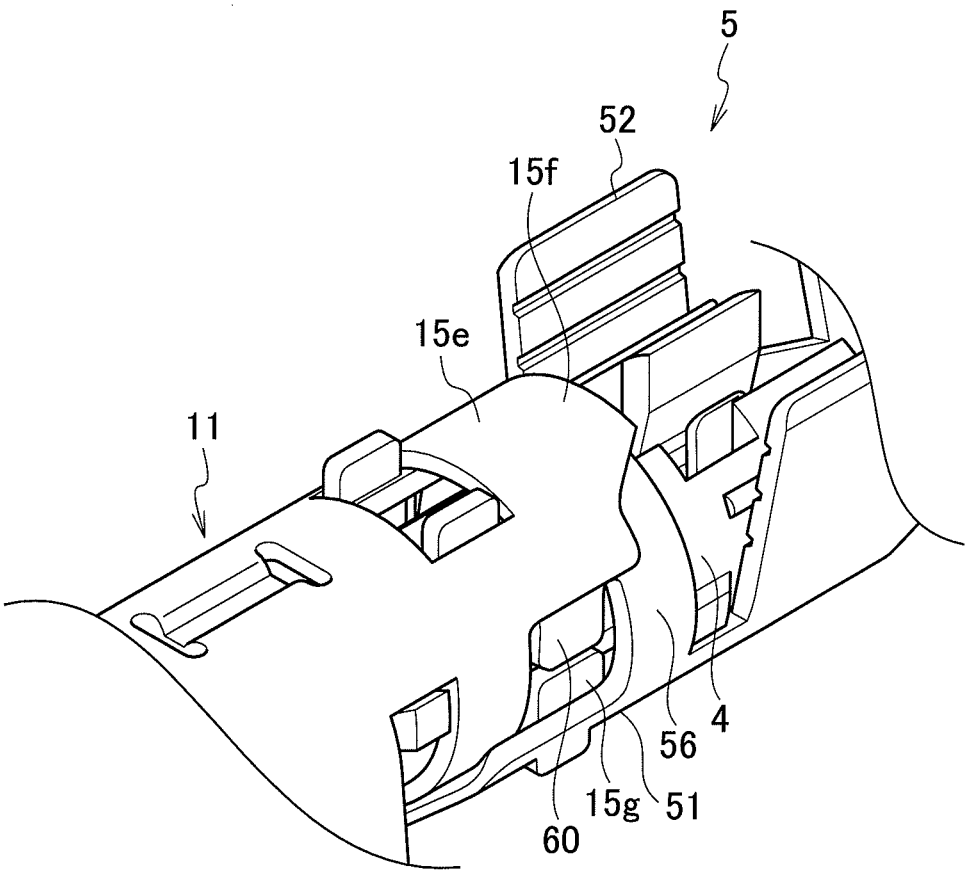
FIG. 10 is a perspective view showing that the shield connector is connected with the mating connector, according to the embodiment of the present invention.

In addition to the above, the cylindrical portion 51 is formed with a stopper portion 60 as shown in FIG. 6 and FIG. 10. The stopper portion 60 is so formed as to protrude, as a small piece, from the end face at each of the divided pieces 56*a*, 56*b* of the first semi-cylindrical wall 56. At the time of mating of the shield connector 1 with the mating connector 11, the stopper portion 60 is engaged with a stopper portion 15*g* of the mating connector 11. This engaging is made to prevent upward-downward deviations at the time of mating of the shield connector 1 with the mating connector 11.

The shield connector 1 having the above structure is a male connector. The shield connector 1 on this male side and the mating connector 11 on the female side are mated with each other, to thereby accomplish the connection between the connectors.

The mating connector 11 serving as the female connector is a shield connector, like the shield connector 1, has the same configuration as that of the shield connector 1 on the male side. That is, the mating connector 11 has an inner terminal 13 having the same configuration as that of the inner terminal 3 of the shield connector 1 on the male side, an inner housing 14 having the same configuration as that of the inner housing 4 of the shield connector 1 on the male side, and an outer terminal 15 having the same configuration as that of the outer terminal 5 of the shield connector 1 on the male side.

As shown in FIG. 11, the inner terminal 13 of the mating connector 11 on the female side has a crimp barrel portion 13*a* connected to the core wire 21 by being crimped to the core wire 21 of the shield electric cable 2, an electric connecting portion 13*b* connected to the end of the core wire 21, and an impedance adjusting portion 13*c* having the same configuration as that of the impedance adjusting portion 35 of the shield connector 1 on the male side.

In this case, the electric connecting portion 31 of the shield connector 1 on the male side enters into the electric connecting portion 13*b*, to thereby bring the electric connecting portion 13*b* into contact with the electric connecting portion 31 of the shield connector 1 and make the electric connecting portion 13*b* conductive with the electric connecting portion 31. For allowing the above entry of the electric connecting portion 31, the electric connecting portion 13*b* is formed to be cylindrical. The impedance adjusting portion 13*c* is provided between the crimp barrel portion 13*a* and the electric connecting portion 13*b*. In the portion provided with the impedance adjusting portion 13*c*, the impedance is so operated as to be lower, like the shield connector 1 on the male side. This averages the impedance of the entirety of the mating connector 11, thus enabling to improve the high frequency performance of the mating connector 11, like the shield connector 1 on the male side.

Like the inner housing 4 of the shield connector 1 on the male side, the inner housing 14 of the mating connector 11 receives therein the inner terminal 13. For receiving the inner terminal 13, like the shield connector 1 on the male side, the inner housing 14 is formed with a receiving recess portion (not shown). In the above receiving of the inner terminal 13, the cylindrical electric connecting portion 13*b* is brought into a state of protruding to the shield connector side on the male side. Further, the inner housing 14 is formed with a mating groove portion (not shown) with which, like the shield connector 1 on the male side, the impedance adjusting portion 13*c* of the inner terminal 13 is mated to thereby position and fix the inner terminal 13.

The outer terminal 15 of the mating connector 11 has such a structure as that, as shown in FIG. 11, a cylindrical portion 15*a* having the same configuration as that of the cylindrical portion 51 of the shield connector 1 on the male side, a terminal body portion 15*b* having the same configuration as that of the terminal body portion 52 of the shield connector 1 on the male side, and a shield member connecting portion 15*c* having the same configuration as that of the shield member connecting portion 53 of the shield connector 1 on the male side are continuously formed along the axial direction. The inner housing 14 receiving therein the inner terminal 13 is assembled into the terminal body portion 15*b*, and the shield member connecting portion 15*c* is crimped and connected with the shield member 23 that is exposed by peeling off the outer cover 24.

The cylindrical portion 51 of the tapered shield connector 1 on the male side is mated with the cylindrical portion 15*a*. As shown in FIG. 6, like the cylindrical portion 51 of the shield connector 1 on the male side, the cylindrical portion 15*a* is formed with a first semi-cylindrical wall 15*d* given elasticity capable of sagging by forming a slit (not shown) and a second semi-cylindrical wall 15*e* positioned in the upper portion and opposing the first semi-cylindrical wall 15*d* positioned in the lower portion. Further, a distal end of the second semi-cylindrical wall 15*e* is formed with a connector pick protrusion 15*f* like the connector pick protrusion 59 on the shield connector 1 side. The first semi-cylindrical wall 15*d* is formed with the stopper portion 15*g* like the stopper portion 60 on the shield connector side.

The above outer terminal 15 of the mating connector 11 has the same configuration as that of the outer terminal 5 of the shield connector 1 on the male side and can be shared between the mating connector 11 and the shield connector 1. In this case, the mutual mating is implemented with the male and female connectors 1, 11 vertically reversed relative to each other. That is, in the mating connector 11 on the female side, the outer terminal 15 is set upside down relative to the outer terminal 5 of the shield connector 1 on the male side, and the outer terminal 15 is mated with the outer terminal 5 of the shield connector 1 on the male side in this upside-down state (refer to FIG. 5 and FIG. 6).

As stated above, configuring the structure such that the outer terminals 5 and 15 mutually mated have the same configuration and can be mated in the upside-down state makes the outer terminals 5, 15 shared between the male connector 1 and the female connector 11. Thus, it is not necessary to make the outer terminals 5, 15 in different configurations for mutual mating, thus eliminating the need of producing the outer terminals 5, 15 in different configurations. Thus, the need of separately preparing metal molds for production can be eliminated, thus enabling to reduce the production cost.

Next, an explanation will be given on mating and thereby connecting the male connector 1 and the female connector 11.

FIG. 7 shows the inside of the shield connector 1 on the male side before the mating. The inner housing 4 receiving therein the inner terminal 3 is incorporated into the outer terminal 5. Before the mating as shown in FIG. 7, a center axis A (upper) of the outer terminal 5 is deviated from a center axis B (lower) of the inner terminal 3.

FIG. 6 shows a confronting state for mating the male connector 1 with the female connector 11. The confronting is implemented with the outer terminal 15 of the mating connector 11 on the female side in an upside-down state relative to the outer terminal 5 of the shield connector 1 on the male side. That is, the confronting is so implemented that the first semi-cylindrical wall 56 of the cylindrical portion 51 of the shield connector 1 on the male side is caused to face the second semi-cylindrical wall 15*e* of the cylindrical portion 15*a* of the mating connector 11 on the female side and the second semi-cylindrical wall 57 of the cylindrical portion 51 of the shield connector 1 on the male side is caused to face the first semi-cylindrical wall 15*d* of the cylindrical portion 15*a* of the mating connector 11 on the female side.

In this case, the confronting is implemented by deviating upward and downward the center axes A, C of the outer terminals 5, 15 each by an amount equivalent to a plate thickness of one of the respective cylindrical portions 51, 15*a*. Then, the male connector 1 is mated with the female connector 11 in this state. In this case, the connector pick protrusion 59 in the second semi-cylindrical wall 57 of the cylindrical portion 51 of the connector 1 on the male side picks the first semi-cylindrical wall 15*d* of the cylindrical portion 15*a* of the mating connector 11 on the female side and the connector pick protrusion 15*f* in the second semi-cylindrical wall 15*e* of the cylindrical portion 15*a* of the mating connector 11 on the female side picks the first semi-cylindrical wall 56 of the cylindrical portion 51 of the shield connector 1 on the male side, to thereby implement the mating. Thus, the male connector 1 can be mated with the female connector 11 easily and reliably.

With the above mating, the first semi-cylindrical wall 56 of the shield connector 1 on the male side is positioned inside the second semi-cylindrical wall 15*e* in the outer terminal 15 of the mating connector 11 on the female side while the first semi-cylindrical wall 15*d* in the outer terminal 15 of the mating connector 11 on the female side is positioned inside the second semi-cylindrical wall 57 of the shield connector 1 on the male side. This allows the center axes A, C of the respective outer terminals 5, 15 to coincide coaxially. Further, the mating of the male connector 1 with the female connector 11, as shown in FIG. 8, allows that, in the shield connector 1 on the male side, the center axis B of the inner terminal 3 coincides with the center axis A of the outer terminal 5 (center of an inner diameter D of the outer terminal 5). With the center axes B and A coinciding with each other at the time of the mating, the high frequency performance of the shield connector 1 on the male side can be maintained.

Further, the first semi-cylindrical wall 56 of the cylindrical portion 51 is positioned inside the second semi-cylindrical wall 15*e* of the outer terminal 15 of the mating connector 11, and the first semi-cylindrical wall 15*d* of the outer terminal 15 of the mating connector 11 is positioned inside the second semi-cylindrical wall 57, thus the cylindrical portion 51 and the cylindrical portion 15*a* of the mating connector 11 can be mated in such a manner as to be mutually positioned. Thus, the outer terminal 5 and the outer terminal 15 of the mating connector 11 can be reliably mated, thus stabilizing the mating state.

Figure 5:
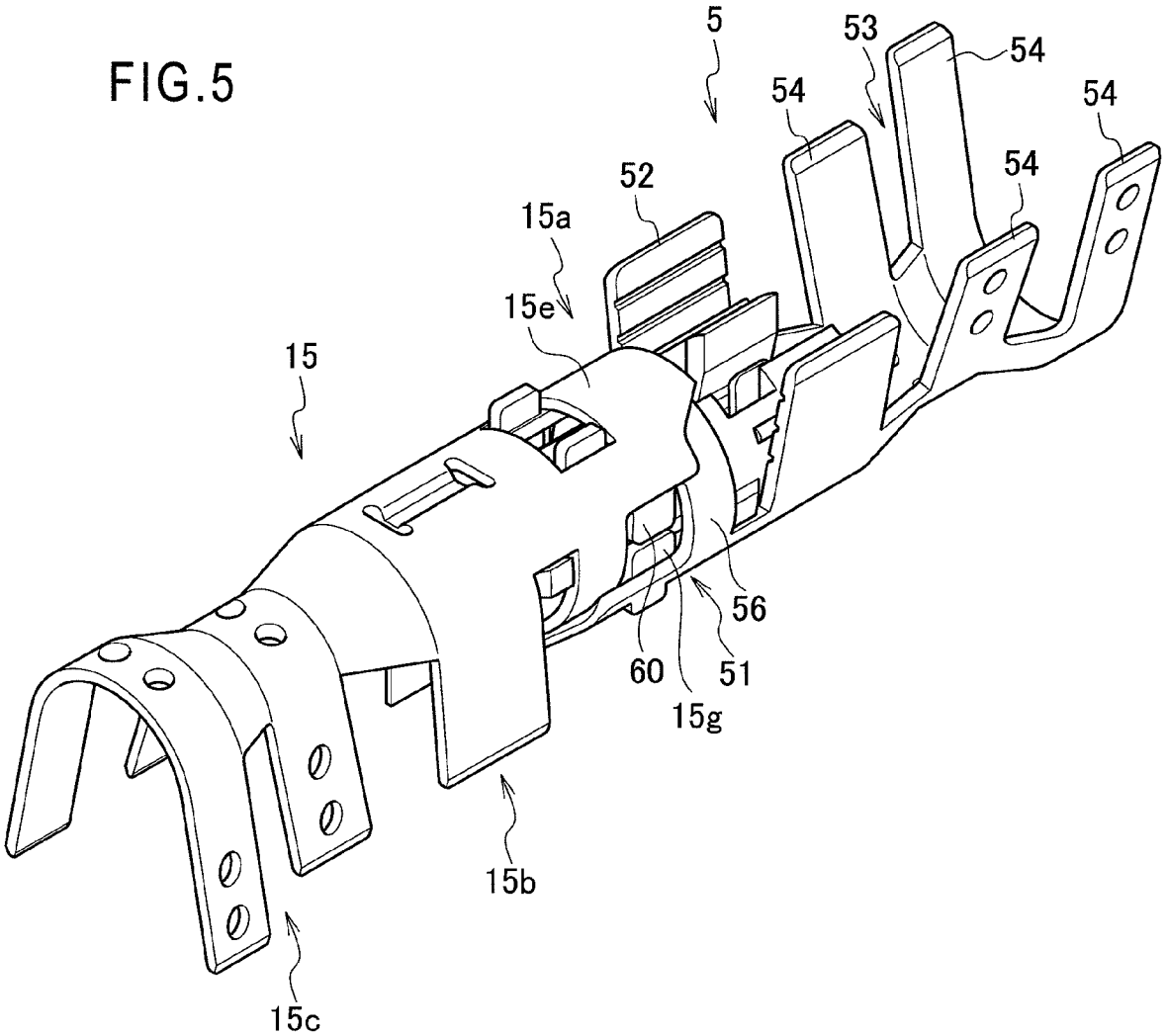
FIG. 5 is a perspective view showing that an outer terminal of the shield connector is connected with an outer terminal of a mating connector side, according to the embodiment of the present invention.

FIG. 5 and FIG. 10 show a state in which the outer terminals 5, 15*a* of the respective male connector 1 and female connector 11 are mated by vertically reversing the outer terminals 5, 15*a*, as set forth above. In the mating state of the outer terminals 5, 15*a*, the stopper portions 60, 15*g* formed at the respective cylindrical portions 51, 15*a* are engaged with each other, thus enabling to prevent upward-downward deviations of the outer terminals 5, 15. This can maintain the accuracy of the mating state.

In addition to this, the slits formed at the first semi-cylindrical walls 56, 15*d* of the respective cylindrical portions 51, 15*a* are covered with the mating second semi-cylindrical walls 15*e*, 57 mated with the first semi-cylindrical walls 56, 15*d*. Thus, the high frequency performance can be maintained despite the formation of the slits.

FIG. 11 shows a state in which the cylindrical portions 51, 15*a*, respectively, at the shield connector 1 on the male side and the mating connector 11 on the female side are mated with each other. In each of the male connector 1 and the female connector 11, the open portion is formed at the shield member 23 portion of the shield electric cable 2, to thereby rise the impedance in the shield member portion (portion M in FIG. 11). However, in either of the connectors 1, 11, the impedance adjusting portions 35, 13*c* are formed at the inner terminals 3, 13, thus acting to lower the impedance near the portion M where the impedance rises (portion N in FIG. 11). With this, the entire impedance can be averaged, thus enabling to improve the high frequency performance. Increasing and decreasing the area of the above impedance adjusting portion 35 can adjust the impedance adjusting amount, thus enabling to easily adjust the impedance.

As explained above, according to the embodiment, the outer terminal 5 has the same configuration as that of the outer terminal 15 of the mating connector 11, thus making the outer terminals 5, 15 sharable between the male and female shield connectors 1, 11. Thus, the mating can be accomplished without the need of preparing the outer terminals having different configurations between the male and female shield connectors 1, 11 to be connected. Thus, the metal mold for producing the outer terminals 5, 15 and the applicator for crimping the outer terminals 5, 15 to the shield electric cable can be shared, thus enabling to reduce the cost not only improving the workability.

Further, since the cylindrical portion 51 of the outer terminal 5 is mated with the cylindrical portion 15*a* of the outer terminal 15 of the mating connector 11 in an upside-down state, so that the outer terminals of the shield connectors 1, 11 to be mutually connected can be easily mated. Further, the outer terminals 5, 15 are mated such that the first semi-cylindrical wall 56 of the cylindrical portion 51 is positioned inside the second semi-cylindrical wall 15*e* of the outer terminal 15 of the mating connector 11, and that the first semi-cylindrical wall 15*d* of the outer terminal 15 of the mating connector 11 is positioned inside the second semi-cylindrical wall 57, thus the cylindrical portion 51 and the cylindrical portion 15*a* of the mating connector 11 can be mated in a mutually aligned state. Thus, the outer terminal 5 and the outer terminal 15 of the mating connector 11 can be reliably mated, thus stabilizing the mating state.

Further, the stopper portions 60, 15*g* engaged with each other to thereby prevent the upward-downward deviation are provided at the cylindrical portion 51 of the outer terminal 5 of the shield connector 1 and the cylindrical portion 15*a* of the outer terminal 15 of the mating connector 11, thus enabling to maintain the accuracy of the mating state with the mating connector 11.

According to the embodiment, the inner terminal 13, inner housing 14 and outer terminal 15 of the mating connector 11 on the female side are the same in configuration as the inner terminal 3, inner housing 4 and outer terminal 5 of the shield connector 1 on the male side. However, the inner terminal 3, 13 may have different configurations and the inner housings 4, 14 may have different configurations, provided that the outer terminals 5, 15 for mating the male and female connectors 1, 11 have the same configuration. Even in the case of the inner terminals 3, 13 having the different configurations, the impedance adjusting portions 35, 13*c* can be formed at the male and female connectors 1, 11 when it is necessary to improve the high frequency performance of each of the male and female connectors 1, 11 is necessary.

What is claimed is:

1. A shield connector to be connected to a terminal of a shield electric cable having a core wire covered with a shield member via insulation, the shield connector comprising:

an inner terminal connected to an end of the core wire and provided with an electric connecting portion electrically connected with a mating terminal;

an insulation inner housing to receive therein the inner terminal; and an outer terminal into which the insulation inner housing receiving therein the inner terminal is incorporated, and which is to be mated with a mating connector in a state where the shield member is connected to the outer terminal and the electric connecting portion of the inner terminal is positioned in the outer terminal, wherein the outer terminal has the same configuration as that of an outer terminal of the mating connector, thus making the outer terminals, sharable between male and female connectors, wherein the outer terminal includes:

a terminal body portion incorporating the insulation inner housing which receives the inner terminal therein, a shield member connecting portion to which the shield member is connected, and a cylindrical portion in which the electric connecting portion of the inner terminal is positioned and which is to be mated with the mating connector, and wherein the cylindrical portion includes a first semi-cylindrical wall formed with a slit and a second semi-cylindrical wall opposing the first semi-cylindrical wall, the outer terminal of the shield connector and the outer terminal of the mating connector are mated with each other in an upside-down mating state of the shield connector with the mating connector, the first semi-cylindrical wall of the outer terminal of the shield connector is positioned inside a second semi-cylindrical wall of the outer terminal of the mating connector, and a first semi-cylindrical wall of the outer terminal of the mating connector is positioned inside the second semi-cylindrical wall of the outer terminal of the shield connector.

2. The shield connector according to claim 1 wherein the cylindrical portion of the shield connector is provided with a stopper portion, the mating connector includes a cylindrical portion provided with a stopper portion, and the stopper portion of the shield connector and the stopper portion of the mating connector are engaged with each other, to thereby prevent an upward-downward deviation of the shield connector and the mating connector.

3. A connector including:

an inner terminal configured to be connected to a wire;

an insulation inner housing that includes an opening that is configured to receive the inner terminal; and a first outer terminal that includes an opening that is configured to receive the insulation inner housing and the inner terminal, wherein the connector is configured to be connected a mating connector that includes a second outer terminal that has a same shape as the first outer terminal so as to make the first outer terminal and the second outer terminal interchangeable with one another, wherein cross sections of the first and second outer terminals in a first direction are the same as one another, and cross sections of the first and second outer terminals in a second direction that intersects the first direction are the same as one another.

4. The connector according to claim 3, wherein the connector is a male connector and the mating connector is a female connector.

* * * * *